US006405689B1

(12) United States Patent
Iijima

(10) Patent No.: US 6,405,689 B1
(45) Date of Patent: Jun. 18, 2002

(54) V-ENGINE COOLING DEVICE

(75) Inventor: Akira Iijima, Kawasaki (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/762,736

(22) PCT Filed: Jun. 14, 2000

(86) PCT No.: PCT/JP00/03867

§ 371 (c)(1),
(2), (4) Date: Feb. 12, 2001

(87) PCT Pub. No.: WO00/77356

PCT Pub. Date: Dec. 21, 2000

(30) Foreign Application Priority Data

Jun. 14, 1999 (JP) ..... 11-166869
Jun. 14, 1999 (JP) ..... 11-166870

(51) Int. Cl.[7] ..... F01P 5/10
(52) U.S. Cl. ..... 123/41.44; 123/41.28
(58) Field of Search ..... 123/41.28, 41.29, 123/41.31, 41.33, 41.44

(56) References Cited

U.S. PATENT DOCUMENTS 4,681,067 A 7/1987 Tamba et al. ..... 123/41.1
5,497,734 A * 3/1996 Okada ..... 123/41.1
5,970,927 A * 10/1999 Suzuki ..... 123/41.29

FOREIGN PATENT DOCUMENTS

JP 62-91615 4/1987
JP 7-189694 7/1995
JP 11-107770 4/1999
JP 11-270338 10/1999
JP 2000-97028 4/2000

* cited by examiner

*Primary Examiner*—Willis R. Wolfe
*Assistant Examiner*—Katrina B. Harris
(74) *Attorney, Agent, or Firm*—McCormick, Paulding & Huber LLP

(57) ABSTRACT

An object of the present invention is to realize both good cooling balance between two banks (2, 3) and good oil cooling performance, and further reduce temperature difference between the banks. A cooling system for a V-type engine according to the present invention causes the cooling water supplied from a water pump (10) to be distributed to the banks (2, 3) of the engine (1) after an oil cooler (15). The cooling water prior to cooling the engine can cool the oil sufficiently, and the cooling water after passing the oil cooler (15) is distributed to the banks (2, 3) equally so that no temperature difference arises between the banks. A connection tube (18) for communicating water jackets of the banks (2, 3) is integrally formed with a housing member (20) mounted on an end of the engine in a crankshaft direction. Since an existing flywheel housing (20) or the like is utilized, a separate pipe is not necessary, and therefore easy layout and size reduction are realized.

9 Claims, 3 Drawing Sheets

III-III CROSS SECTION

V-ENGINE COOLING DEVICE

BACKGROUND OF THE INVENTION

1. Field of the Invention

The present invention relates to cooling systems for a V-type engine including a V-type diesel engine.

2. Description of the Related Art

Generally, a water cooling system used in a V-type engine has the following structure and function (e.g., Japanese Patent Application, Laid Open Publication Nos. 62-91615 and 7-189694). A water pump is attached to one end of an engine in a crankshaft direction, and cooling water discharged from the water pump is distributed to both banks of the engine such that it flows through the banks in the crankshaft direction. The cooling water is then collected into a collection pipe at the other end of the engine and introduced to a radiator. Subsequently, the cooling water is returned to the water pump from the radiator.

In the meantime, an oil cooler of water-cooled type is sometimes provided for cooling an oil. In such a case, if the cooling water which has cooled the engine is used as a cooling medium for cooling the oil, the oil may not be sufficiently cooled since the cooling water is already hot.

To overcome this problem, proposed are oil cooler arrangements as shown in FIGS. 4 and 5. In the drawings, reference symbols "a" indicates a water pump, "b" and "c" indicate a cylinder block and cylinder head of each bank of the engine, "d" indicates a collection pipe, "e" indicates: a radiator, and "f" indicates an oil cooler.

In FIG. 4, the cooling water is bifurcated immediately downstream of the water pump "a" and one branch flow of cooling water passes the oil cooler "f" prior to entering the cylinder block "b" of one of the banks. In FIG. 5, the cooling water is drawn out from an upstream portion of the cylinder block "b" of one of the banks and introduced to the oil cooler "f" and collection pipe "d." According to these arrangements, the cooling water before used for cooling the engine is employed as the oil cooling medium so that sufficient oil cooling can be expected.

In FIG. 4, however, the hot cooling water, which has passed the oil cooler, is introduced to one of the banks so that temperature difference arises between the banks. The arrangement of FIG. 5 also has a problem that an amount (or flow rate) of cooling water which flows through one of the banks having the oil cooler "f" is smaller than the other bank. As a result, temperature difference arises between the banks.

As described above, the conventional arrangements cannot realize both the good cooling balance between the two banks and the good oil cooling performance.

In a normal arrangement, the water pump is located at a front end of the engine and the collection pipe is located at the rear end of the engine.

However, additional devices such as a fuel injection system (in the case of diesel engine) and a turbocharger are often situated at or near the rear end of the engine. Thus, it is difficult to locate the collection pipe, which is a separate element, at the engine rear end. Further, the existence of the collection pipe requires a larger space at the engine rear end.

An object of the present invention is to realize both the good cooling balance between the two banks and the good oil cooling performance.

Another object of the present invention is to equalize the temperature and amount of cooling water introduced to the two banks so that there is no temperature difference between the banks.

Still another object of the present invention is to design a compact engine.

Yet another object of the present invention is to eliminate a separate pipe connecting the banks so that the number of parts required is reduced and a layout problem does not arise in the engine room.

Another object of the present invention is to improve rigidity and reduce vibration noise.

SUMMARY OF THE INVENTION

According to one aspect/embodiment of the present invention, there is provided a cooling system for a V-type engine characterized in that cooling water supplied from a water pump is distributed to two banks of the engine after the cooling water passes an oil cooler.

Since the cooling water is introduced to the oil cooler before it cools the engine, it can cool the oil sufficiently. Further, since the cooling water is introduced to the banks after passing the oil cooler, temperature and amount of the cooling water to be entered to the two banks are equal. Thus, there is no temperature difference between the banks.

Preferably, the water pump is provided at an end of the engine in a crankshaft direction and a connection pipe connecting water jackets of the banks is provided at the other end of the engine such that the cooling water discharged from the water pump is caused to flow in the connection pipe after the oil cooler and is introduced to the water jackets of the banks from the connection pipe.

Preferably, the connection pipe has an inlet for accepting the cooling water from the oil cooler, at least two outlets positioned in series in a flow direction of the cooling water from the inlet and communicated with water jackets of the. banks of the engine respectively, and a throttle portion between the outlets for reducing a cross section of the connection tube.

The connection tube is preferably tapered between the outlets such that the connection tube is more throttled as it goes upstream, a most throttled portion preferably defines the throttle portion, and the throttle portion is preferably located immediately downstream of the upstream outlet.

It is preferred that the connection tube is integrally formed on a flywheel housing.

According to another aspect/embodiment of the present invention, there is provided a cooling system for a V-type engine characterized in that a connection tube for connecting water jackets of two banks of an engine is integrally formed with a housing member mounted on an end of the engine in a crankshaft direction.

Since the housing member which is generally mounted on an end of the engine in the crankshaft direction is used to integrally form the connection tube, a separate, pipe is unnecessary and therefore easy layout and size reduction are realized.

Preferably, the housing member is a flywheel housing.

DETAILED DESCRIPTION OF THE INVENTION

Now, embodiments of the present invention will be described in reference to the accompanying drawings.

Figure 1:
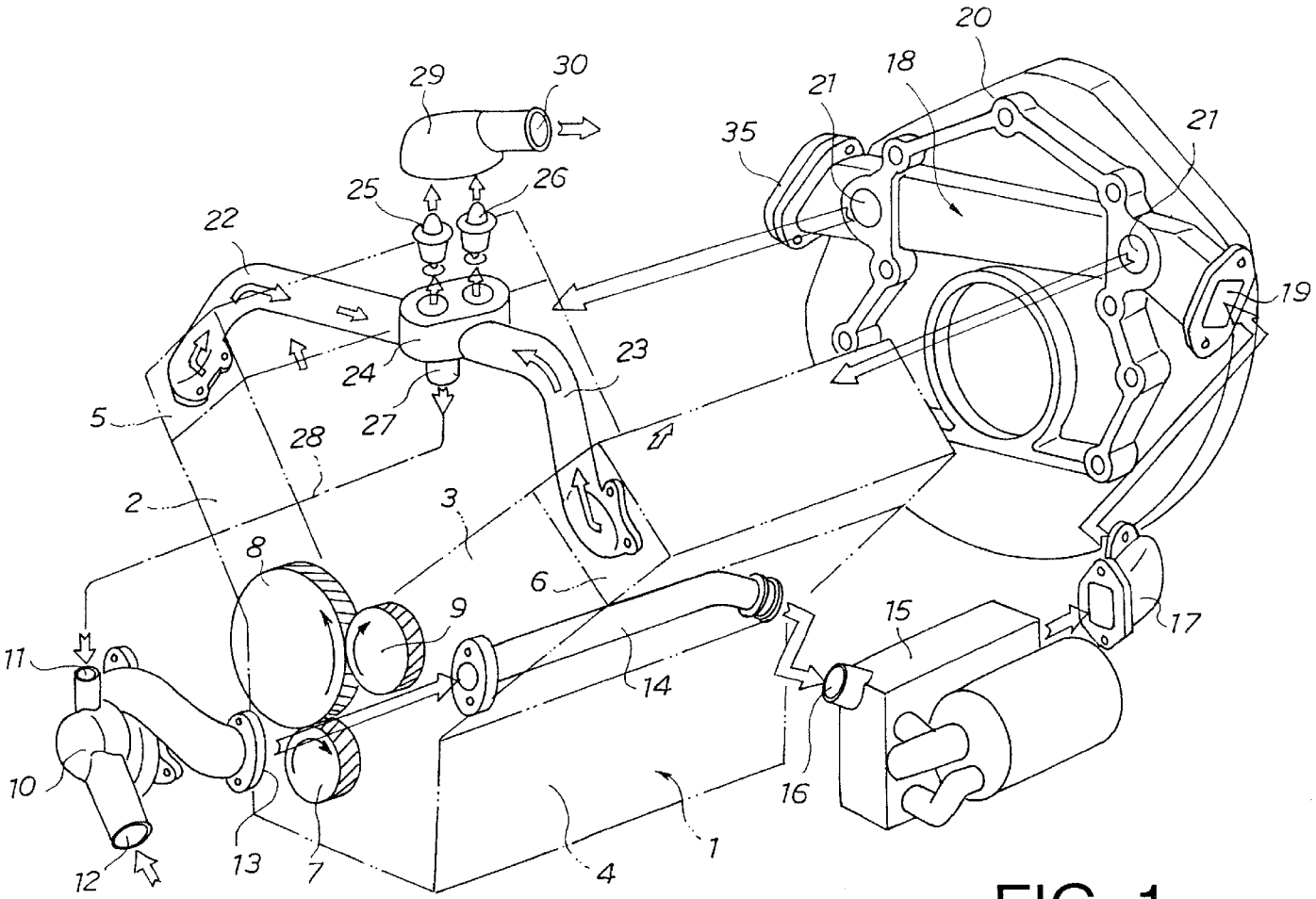
FIG. 1 illustrates a perspective view of an engine equipped with a cooling arrangement according to one embodiment of the present invention.

Referring to FIG. 1, illustrated is an arrangement for cooling a V-type engine of the present invention. The V-type engine 1 has right and left banks 2 and 3, and a cylinder block 4 is situated below these-banks 2 and 3. On the top of the banks, provided are cylinder heads 5 and 6. A crank gear 7 is mounted on one end (front end) of a crankshaft (not shown) of the engine 1, and an idle gear 8 and pump gear 9 are rotatably provided at the front end of the engine 1 such that the gears 8 and 9 are driven (rotated) by the crank gear 7. A water pump 10 is also mounted on the front end of the engine 1 such that it is driven by the pump gear 9. The water pump 10 has two inlets 11 and 12 to accept the cooling water and one outlet 13 to discharge the cooling water. In the drawing, the unshaded arrow indicates a flow direction of cooling water.

The outlet 13 of the water pump 10 projects to the right of the engine 1 and is directed to the rear. To this outlet 13, connected is an inlet of a cooler inlet tube 14. The cooler inlet tube 14 extends to the rear and its downstream end (outlet) connects to a cooling water inlet 16 of a water-cooled oil cooler 15. In the oil cooler 15, the oil (engine lubrication oil) and cooling water are heat-exchanged with each other to cool the oil. The exit of the oil cooler 15 is communicated with a bent coupling tube 17. The oil cooler 15 is located at an mid position of the engine 1 in the crankshaft direction such that the longitudinal direction of the oil cooler matches the crankshaft direction. The oil cooler 15 has an exit in a rear portion thereof in its longitudinal direction, and the coupling tube 17 extends from the oil cooler exit.

The liaison tube 17 bends at its mid way and directed to the left, and the exit of the liaison tube 17 is connected to an entrance 19 of a bridge tube 18.

The bridge tube 18 connects the right and left banks 2 and 3 of the engine 1 (as seen looking onto the rear end of the engine). Specifically, it spans a left water jacket (not shown) and a right water jacket (not shown) of the cylinder block 4. In the illustrated embodiment, the bridge tube 18 is integrally formed with a flywheel housing 20, which is a housing member in the claims. Therefore, the flywheel housing 20, which is normally mounted on the rear end of the engine 1 in the crankshaft direction, is utilized to provide/define the bridging tube 18. The bridging tube 18 extends in right and left directions, and has an inlet 19 at its right end and two outlets 21 formed in series and spaced from the inlet 19 in the longitudinal direction of the tube (flow direction of the cooling water). These outlets 21 are directly communicated with the water jackets of the right and left banks 2 and 3.

At the front end of the engine 1, exit tubes 22 and 23 extend from the front faces of the cylinder heads 5 and 6 respectively. These exit tubes 22 and 23 meet at the center between the banks 2 and 3. Specifically, the exit tubes extend to a thermostat casing 24. Two thermostats 25 and 26 are received in the thermostat casing 24. One of them 25 is a two-stage open type, and the other one 26 is a single stage open type. A bypass outlet 27 is provided on a bottom of the thermostat casing 24, and a bypass tube 28 extends therefrom to the bypass inlet 11 of the water pump 10.

An upper portion of the thermostat housing 24 is a housing cover 29 which is openable. The housing cover 29 has an outlet 30, which is connected to an inlet of the radiator (not shown) by a pipe (not shown). An outlet of the radiator is connected to the inlet 12 of the water pump 10 by a tube (not shown).

Now, flow of the cooling water in this arrangement will be described. The cooling water supplied from the water pump 10 is directed to the rear in the cooler inlet pipe 14 and introduced to the oil cooler 15. In the oil cooler 15, the cooling water heat-exchanges With the oil and flows into the liaison tube 17 and bridging tube 18. The cooling water is first introduced to the cylinder block 4 of the right bank 3 from the bridging tube 18, and then introduced to the cylinder block 4 of the left bank 2. In this manner, the bridging tube 18 distributes the cooling water to the respective banks 2 and 3.

In the cylinder blocks 4 of the banks 2 and 3, the cooling water flows from the rear to the front. In the meantime, some cooling water ascends toward the cylinder heads 5 and 6. These flows of the cooling water cools the engine 1. After passing through the banks 2 and 3, the cooling water is introduced to the exit pipes 22 and 23 and in turn to the thermostat housing 24. When the thermostats 25 and 26 are both closed, all the cooling water is returned to the water pump 10 from the thermostat housing 24 via the bypass pipe 28. Thus, the cooling water does not go through the radiator so that it is not cooled. This occurs when the engine is just started, i.e., in a warm-up condition or the like.

As the engine is warmed up and the thermostats 25 and 26 are opened entirely or partly, the cooling water is allowed to flow to the upwards through the thermostats 25 and 26 in an amount (or flow rate) determined by the opening degree of the thermostats. Then the cooling water is directed to the radiator via the pipe (not shown) from the exit 30 of the thermostat housing. The cooling water is cooled in the radiator, and returned to the water pump 10 via the pipe (not shown) from the inlet 12 of the water pump 10. The remainder of the cooling water which does not flow into the radiator is bypassed to the water pump 10 through the bypass line 28.

Although not illustrated, the engine 1 has pipes and routes, which extend through a heater core for heating a passenger compartment of a vehicle. The cooling water is replenished by feeding the cooling water to the radiator from a reserve tank.

As understood from the foregoing, since the cooling water supplied from the water pump 10 is caused to flow into the oil cooler 15 prior to introduction to the engine, the oil is cooled with the cold cooling water and therefore the cooling water can demonstrate sufficient oil cooling performance. In addition, since the cooling water is equally distributed to the banks 2 and 3 of the engine 1 after passing through the oil cooler 15, no temperature difference arises between the banks 2 and 3. In this manner, both the good oil cooling performance and the good cooling balance between the banks are realized.

Furthermore, because the water pump 10 is provided at one end of the engine 1 in the crankshaft direction, the bridging tube 18 is provided at the other end of the engine, the cooling water supplied from the water pump 10 is introduced to the bridging tube 18 after the oil cooler 15 and it is then distributed to the water jackets of the two banks 2 and 3 of the engine 1 from the bridging tube 18, it is possible to design the engine 1 compact.

Specifically, in the arrangement of the present invention, the cooling water from the water pump 10 at the engine front is first fed to the engine rear, and on its way the cooling water passes the oil cooler 15. The cooling water is then introduced to the banks 2 and 3 from the engine rear and returned to the water pump 10 at the front. If the cooling water flows into the oil cooler 15 at the engine front, and simultaneously the cooling water is fed to the right and left banks 2 and 3 from the front, then the piping and oil cooler 15 should be crowdedly located at the engine front. This makes the engine part layout complicated at the engine front and makes the engine larger. Further, one pipe is required to return the cooling water from the engine rear to the front.

According to the illustrated arrangement, a problem of complicated layout at the engine front would not arise. Accordingly, the engine parts can be located in an efficient manner so that it is possible to design a compact engine.

In particular, since the oil cooler 15 is located at a mid point of the engine 1 in the crankshaft direction and beside the engine 1, and extends in the crankshaft direction, the length of the oil cooler 15 is effectively utilized to reduce the length of the pipes connecting the engine front to the engine rear (namely, the pipes 14 and 17).

In the meantime, the illustrated arrangement has another remarkable feature that the bridging pipe 18 is integrally formed with/on the flywheel housing 20. Now, the structure of the flywheel housing 20 will be described in detail.

Figure 2:
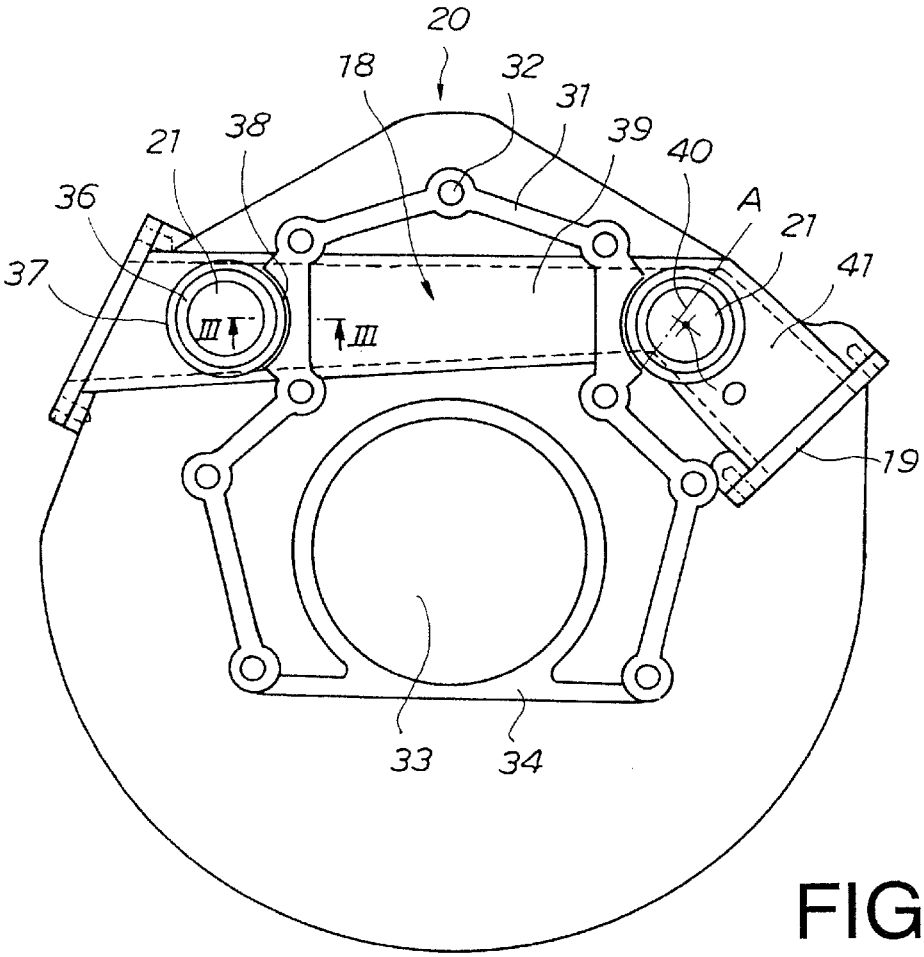
FIG. 2 illustrates a front view of a flywheel housing.

Referring to FIG. 2, the flywheel housing 20 is a single cast product, and a rib 31 projecting from a front face of the flywheel housing engages with a rear face of the engine 1. The flywheel housing 20 is secured to the engine by a plurality of bolts. Reference numeral 32 designates bolt holes. A flywheel is located behind the housing 20 and its outer periphery is covered. The flywheel housing 20 has a center opening 33 for passage of a rear end of the crankshaft. Reference numeral 34 denotes a reinforcement rib that spans the attachment rib 31 transversely and also extends along the periphery of the center opening 33.

The connection tube 18 is formed integral with an upper portion of the flywheel housing 20. The connection tube 18 extends transversely and has a rectangular cross section, which is elongated in the vertical direction. The forwardly directed outlets 21 are provided outside and near the attachment rib 31. On the right side of the right outlet 21, the connection tube 18 bends diagonally downward, and the free end is the inlet 19. The left free end of the connection tube 18 is not connected to any parts; instead, it is closed by a cap 35 as illustrated in FIG. 1 so that the cooling water does not escape.

Figure 3:
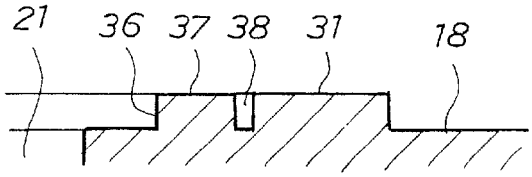
FIG. 3 illustrates a cross sectional view taken along the line III—III in FIG. 2.
Figure 4:
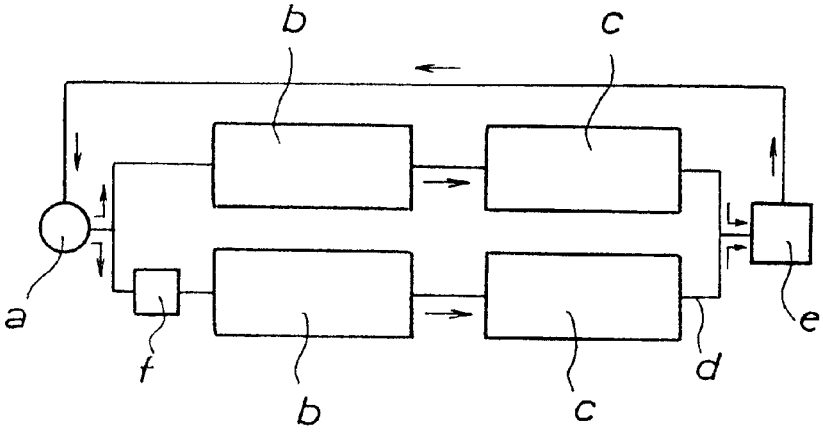
FIG. 4 illustrates an engine cooling arrangement having an oil cooler.
Figure 5:
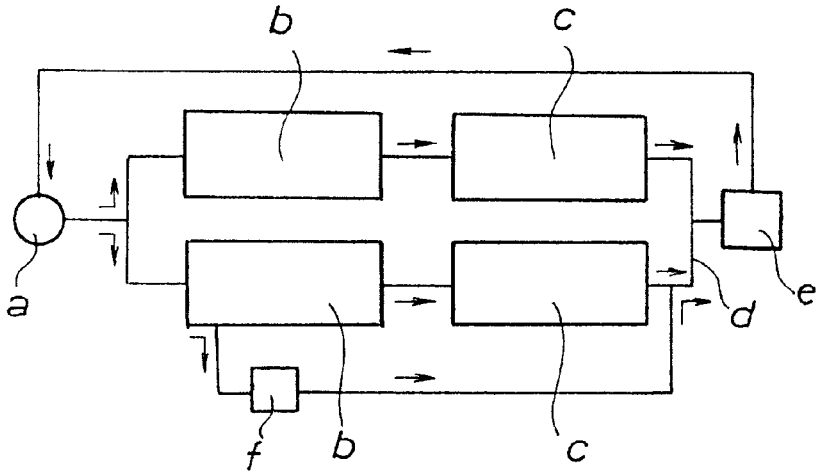
FIG. 5 illustrates another engine cooling arrangement having the oil cooler.

Referring to FIG. 3, the attachment rib 31 projects forward more than the connection tube 18. The outlet 21 is enlarged stepwise to define a shoulder 36 which is coupled to a tubular element (not shown) extending from the cylinder block 4 by a faucet joint. This tubular element is an inlet of the water jacket of the associated bank. An annular portion 37 which also defines the enlarged portion 36 forms a very small gap 38 between itself and the rib 31. The annular portion 37 projects to the same extent as the rib 31.

As illustrated in FIG. 2, the connection tube 18 is preferably tapered from the left outlet 21 to the right outlet 21 (i.e., to the upstream). Here, the whole pipe segment on the left side from the bending position A (i.e., spanning portion 39) is throttled toward the right. The bending position A is immediate left (immediate downstream) of a center O of the right outlet 21. The water passage area (cross section) of the connection tube 18 is most throttled at the bending position A. In this manner, a throttle portion 40 is defined at the bending position A of the connection tube 18.

The connection tube 18 bends at the bending position A, and has an inlet portion 41 on its right side. This inlet portion is tapered in the opposite manner. Specifically, it is tapered toward the left (or toward the downstream). However, the taper is gentler than the spanning portion 39. The right end of the inlet portion 41 is the inlet 19. In this manner, the connection tube 18 has the inlet 19, right outlet 21 and left outlet 21 in series in this order in the cooling water flow direction.

By forming the connection tube 18 integrally with the flywheel housing 20, a separate connection tube (collection tube) which is required in a conventional arrangement is eliminated and therefore the number of parts is reduced and a cost is reduced. In general, the flywheel housing is mounted on the rear of the engine so that the illustrated arrangement takes advantage of it to provide the connection tube. Since one pipe is dispensed with, a space therefore is left. Thus, freedom in the layout is raised and it becomes easier to arrange other parts. Accordingly, the engine rear becomes compact.

Further, since the connection tube 18 serves as a reinforcing rib, rigidity of the flywheel housing 20 and in turn the engine as a whole are improved. This contributes to vibration noise reduction.

Moreover, since the throttle portion 40 equalizes the amounts of cooling water passing through the respective outlets 21, it greatly contributes to elimination of temperature difference between the banks 2 and 3.

Specifically, the right outlet 21 is positioned immediately downstream of the bent pipe 17. Thus, the bending of the pipe 17 causes the cooling water to tend to deflect toward the back of the tube at the right outlet 21. If it were not for the throttle portion 40, the cooling water would flow mostly along the coupling tube 17 at the right outlet 21 in some flow rate conditions and therefore it would be difficult for the cooling water to flow into the perpendicular right outlet 21. In view of this, the cooling water pipe downstream of the right outlet 21 is throttled and becomes a resistance so that the cooling water is easily able to enter the right outlet 21.

If this point is most emphasized, it is only required to locate the throttle portion 40 between the right outlet 2l and left outlet 21. However, the effect of the throttle portion 40 is best demonstrated when the throttle portion 40 is provided immediately downstream of the right outlet 21.

It should be noted that the present invention is not limited to the illustrated and described embodiment. For example, the connection tube 18 may have a plurality of outlets for each of the banks, and the throttle portion may be a projection instead of the taper.

Further, the connection tube 18 may be integrally formed with any housing member spanning the two banks instead of the flywheel housing 20. In the illustrated embodiment, the connection tube 18 is used as a pipe for introducing the cooling water to the banks, but it may be replaced by a collection tube of a conventional arrangement which gathers the cooling water from the banks. In other words, an idea of forming the connection tube 18 integrally with the housing member is applicable to the conventional arrangement.

The instant application claims priority of Japanese Patent Application Nos. 11-166869 and 11-166870 both filed on Jun. 14, 1999, the entire disclosures of which are incorporated herein by reference.

INDUSTRIAL APPLICABILITY

The present invention is applicable to various V-type engines such as V-type diesel and gasoline engines.

What is claimed is:

1. A cooling system for a V engine wherein cooling water supplied from a water pump is distributed to both banks of an engine after passing through an oil cooler.

2. The cooling system for a V engine according to claim 1, wherein the water pump is mounted on one end of the engine in a crankshaft direction, a connection tube for connecting water jackets of the banks of the engine is mounted on the other end of the engine, the cooling water supplied from the water pump is fed to the connection tube after passing through the oil cooler, and the cooling water is further fed to the water jackets of the banks from the connection tube.

3. The cooling system for a V engine according to claim 2, wherein the connection tube includes an inlet for accepting the cooling water after the oil cooler, at least two outlets positioned in series in a flow direction of the cooling water from the inlet and communicated with water jackets of the banks of the engine respectively, and a throttle portion between the outlets for reducing a cross section of the connection tube.

4. The cooling system for a V engine according to claim 3, wherein the connection tube is tapered between the outlets such that the connection tube is more throttled as it goes upstream and a most throttled portion defines the throttle portion, and the throttle portion is located immediately downstream of the upstream outlet.

5. The cooling system for a V engine according to claim 2, wherein the connection tube is integrally formed on a flywheel housing.

6. A cooling system for a V engine wherein a connection tube for connecting water jackets of two banks of an engine is integrally formed on a housing member mounted on an end of the engine in a crankshaft direction.

7. The cooling system for a V engine according to claim 6, wherein the housing member is a flywheel housing.

8. The cooling system for a V engine according to claim 3, wherein the connection tube is integrally formed on a flywheel housing.

9. The cooling system for a V engine according to claim 4, wherein the connection tube is integrally formed on a flywheel housing.

* * * * *